US005174578A

United States Patent [19]

Oka et al.

[11] Patent Number: 5,174,578

[45] Date of Patent: Dec. 29, 1992

[54] GOLF BALL

[75] Inventors: Kengo Oka, Kobe; Shinji Oshima, Nishinomiya, both of Japan

[73] Assignee: Sumitomo Rubber Industries, Ltd., Kobe, Japan

[21] Appl. No.: 691,501

[22] Filed: Apr. 25, 1991

[30] Foreign Application Priority Data

Dec. 19, 1990 [JP] Japan ..... 2-412543

[51] Int. Cl.[5] ..... A63B 37/14

[52] U.S. Cl. ..... 273/232

[58] Field of Search ..... 273/232

[56] References Cited

U.S. PATENT DOCUMENTS

| | | | |
|---|---|---|---|
| 2,106,704 | 2/1938 | Davis | 273/232 |
| 4,869,512 | 9/1989 | Nomura et al. | 273/232 |

FOREIGN PATENT DOCUMENTS

| | | | |
|---|---|---|---|
| 218311 | 4/1987 | European Pat. Off. . | |
| 7222333 | 2/1973 | France . | |
| 48-19325 | 3/1973 | Japan . | |
| 62-79072 | 4/1987 | Japan . | |
| 64-8982 | 1/1989 | Japan . | |
| 189551 | 12/1922 | United Kingdom | 273/232 |

*Primary Examiner*—George J. Marlo

[57] ABSTRACT

A golf ball having 280 to 540 dimples including plural types of dimples of different surface configurations such as circular dimples or regular polygonal dimples formed thereon. The percentage of dimples unadjacent to dimples of different surface configurations is less than 30 of the total number of dimples so that one dimple is adjacent to many dimples of different configurations.

11 Claims, 9 Drawing Sheets

GOLF BALL

BACKGROUND OF THE INVENTION

1. Field of the Invention

The present invention relates to a golf ball, and more particularly, to the golf ball having an improved dimple configuration so that the golf ball has a favorable flight performance which can be obtained by making air flows in the periphery of the golf ball turbulent.

2. Description of the Related Arts

Normally, 280 to 540 dimples are formed on the surface of the golf ball. In order to lift the golf ball high in air, the separation point between air and the upper surface of the golf ball is required to be as backward as possible compared with the separation point between air and the lower surface thereof so as to make air pressure existing above the golf ball smaller than that existing below it. In order to accelerate the separation of air existing above the golf ball from the upper surface of the golf ball, it is necessary to make air flows in the periphery thereof turbulent. In this sense, it is aerodynamically appropriate to arrange dimples irregularly on the surface of the golf ball.

Various dimple arrangements in combination of dimples of various configurations have been proposed to make air flow in the periphery of the golf ball turbulent. For example, according to Japanese Patent Laid-Open Publication No. 48-19325, dimples consist of pentagonal and hexagonal dimples. Japanese Patent Laid-Open Publication No. 62-79072 discloses a dimple arrangement consisting of circular dimples of two different diameters. Japanese Patent Laid-Open Publication No. 64-8982 discloses a dimple arrangement consisting of circular dimples and non-circular dimples. Of the above proposals, according to Japanese Patent Laid-Open Publication No. 48-19325, the percentage of dimples unadjacent to dimples of different configurations is approximately 71.

However, the dimple configurations and arrangements of the above proposals do not make air flow in the periphery of the golf ball turbulent to a satisfactory extent. Consequently, the golf ball does not fly to a player's satisfaction.

SUMMARY OF THE INVENTION

It is therefore an object of the present invention to provide a golf ball capable of flying a long distance. The object can be achieved by arranging on the surface of the golf ball dimples consisting of different configurations so as to increase the turbulence of air flow in the periphery of the golf ball.

In accomplishing these and other objects, the present invention provides a golf ball having plural types of dimples of different surface configurations formed thereon, in which the percentage of dimples unadjacent to dimples of different surface configurations is less than 30 of total number of dimples.

According to the present invention, the surface configuration of a dimple means a dimple configuration viewed along the normal line to the curve of the golf ball at a given point. Preferably, the dimple is circular or regular polygonal. The following combinations of different dimple configurations are preferably adopted: a combination of circular dimples and regular polygonal dimples, for example, regular octagonal dimple or a combination of regular polygonal dimples consisting of different number of sides, for example, regular quadrangular dimples and regular hexagonal dimples.

The reason dimples are circular or regular polygonal is because almost a uniform dimple effect can be obtained even though the golf ball rotates in its back spin on a different axis during its flight. Dimples in other than a circular configuration or a regular polygonal configuration may be formed in a minimum number on the surface of the golf ball in order to reduce bald area.

Since dimples are formed on the spherical surface of the golf ball, a regular polygonal dimple cannot be formed thereon. But according to the present invention, a dimple which is regular polygonal when it is viewed along the normal line to the curve of the golf ball at a given point is regarded as a regular polygonal dimple.

Circular dimples different from each other in diameter or regular quadrangular dimples different from each other in side length is regarded as dimples of the same surface configuration, respectively.

According to the present invention, two dimples are "adjacent" to each other if the following conditions are satisfied: the line connecting the centers of the two dimples is unintersecting with other dimples and the distance between the two dimples is less than 6.5 mm.

Dimples are formed on the surface of the golf ball in order to increase a turbulence in the air flow in the periphery of the golf ball, i.e., in order to fly the golf ball a long distance. To this end, the more a dimple is adjacent to dimples of different surface configurations, the more the dimple effect is. According to the present invention, the percentage of dimples unadjacent to dimples of different configurations is less than 30 of all dimples. If the percentage is more than 30, the turbulence degree of air flow in the periphery of the golf ball is insufficient. Consequently, the flight distance of the golf ball cannot be increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become apparent from the following description taken in conjunction with the preferred embodiments thereof with reference to the accompanying drawings which are given by way of illustration only, and thus are not limitative of the present invention, and in which.

DETAILED DESCRIPTION OF THE INVENTION

Figure 1:
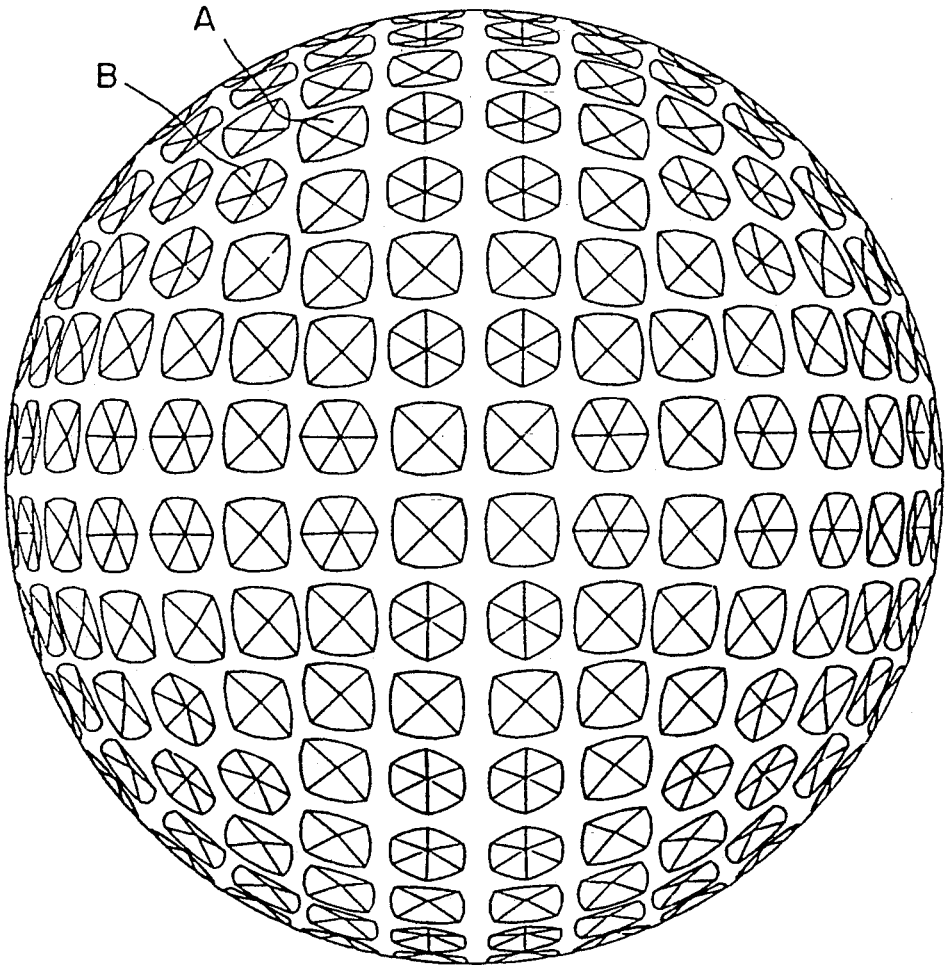
FIG. 1 is a front view of a golf ball according to a first embodiment of the present invention.

Before the description of the present invention proceeds, it is to be noted that like parts are designated by like reference numerals throughout the accompanying drawings.

Referring to the accompanying drawings, the embodiments of the present invention are described below.

Figure 2:
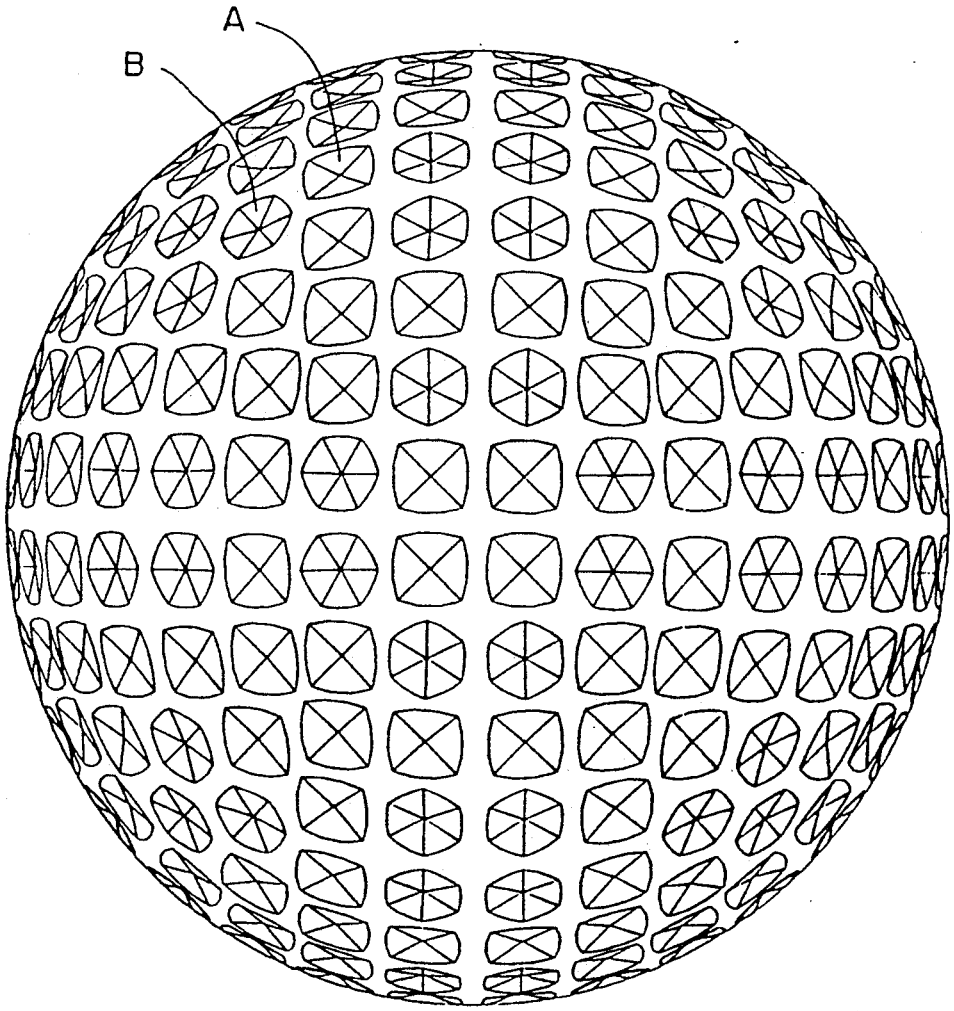
FIG. 2 is a plan view of a golf ball according to the first embodiment of the present invention.

FIGS. 1 and 2 show a first embodiment of the present invention. The golf ball has on the spherical surface thereof regular quadrangular dimples (A) and regular hexagonal dimples (B). Each dimple (A) is adjacent to at least one dimple (B). That is, there is no dimple (A) which is not adjacent to dimples (B). Similarly, each dimple (B) is adjacent to at least one dimple (A). That is, there is no dimple (B) which is not adjacent to dimples (A).

Figure 3:
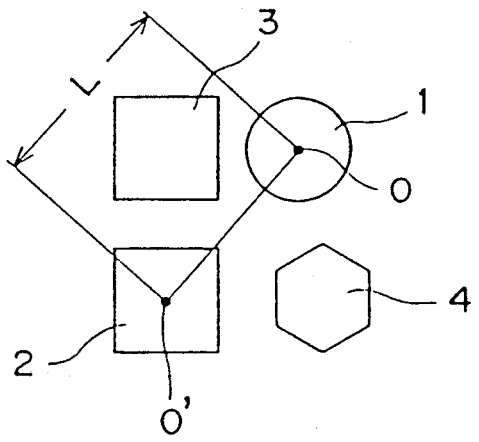
FIG. 3 is a schematic view for explaining "adjacent dimples" according to the present invention.
Figure 4:
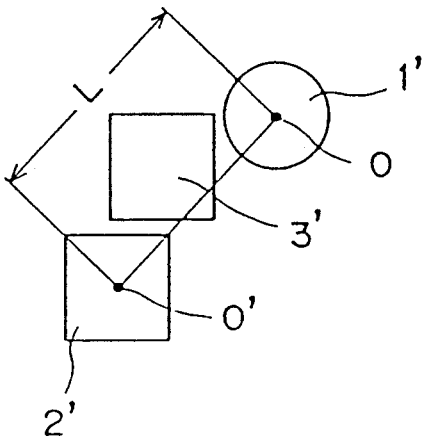
FIG. 4 is a schematic view for explaining "adjacent dimples" according to the present invention.

According to the present invention, as shown in FIG. 3, the term "adjacent" is defined as the condition in which the straight line (L) connecting the center (O) of a dimple 1 and the center (O') of a dimple 2 is unintersecting with other dimples 3 or 4 and the length of the straight line is less than 6.5 mm. In this sense, dimples 1 and 2 are adjacent to each other if the straight line (L) is less than 6.5 mm while they are unadjacent to each other if the line (L) is more than 6.5 mm. Referring to FIG. 4, dimples 1' and 2' are unadjacent to each other because the straight line (L) connecting the centers of the dimples 1' and 2' intersects with a dimple 3' as shown in FIG. 4.

According to the golf ball of the first embodiment as shown in FIGS. 1 and 2, the length of the diagonal line of the regular quadrangular dimple (A) is 4.10 mm. The diagonal line of a regular polyhedron is hereinafter referred to as the length thereof. The total number of the dimples (A) is 216. The length of the regular hexagonal dimple (B) is 3.70 mm. The total number of the dimples (B) is 120.

Figure 5:
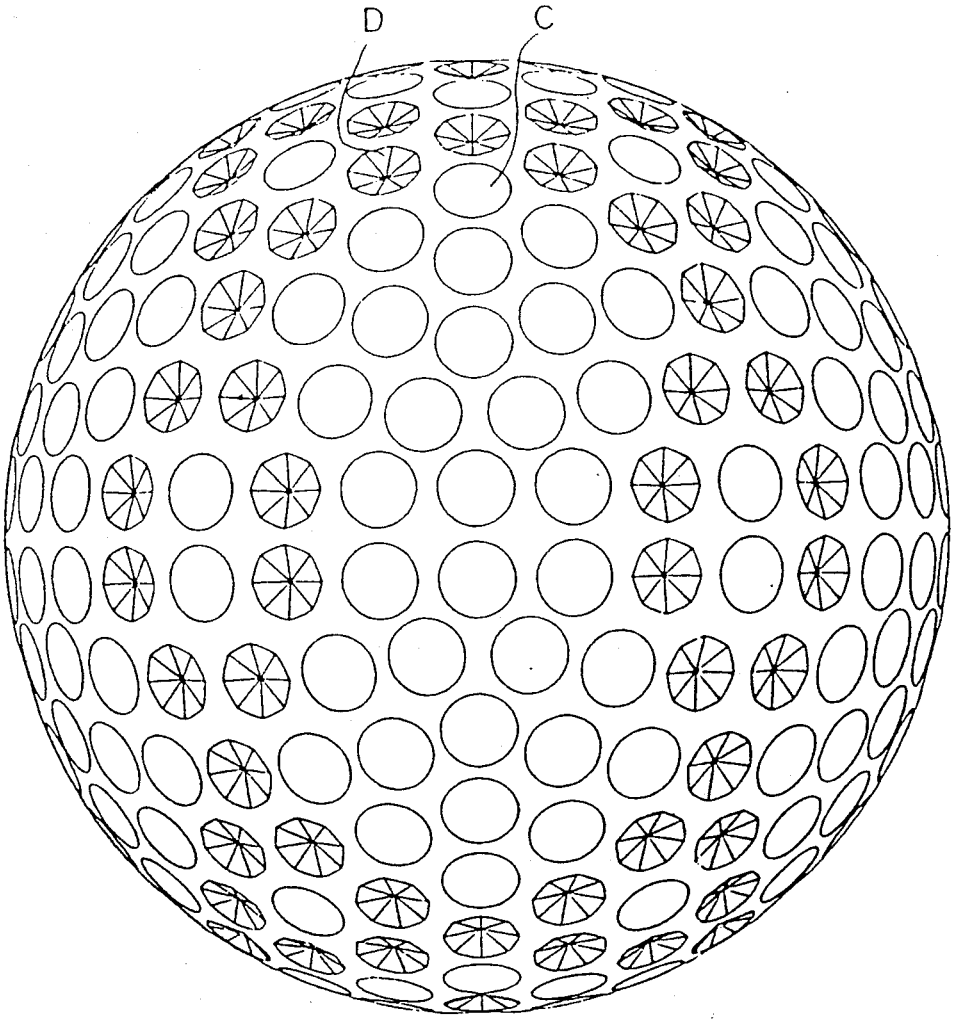
FIG. 5 is a front view of a golf ball according to a second embodiment of the present invention.
Figure 6:
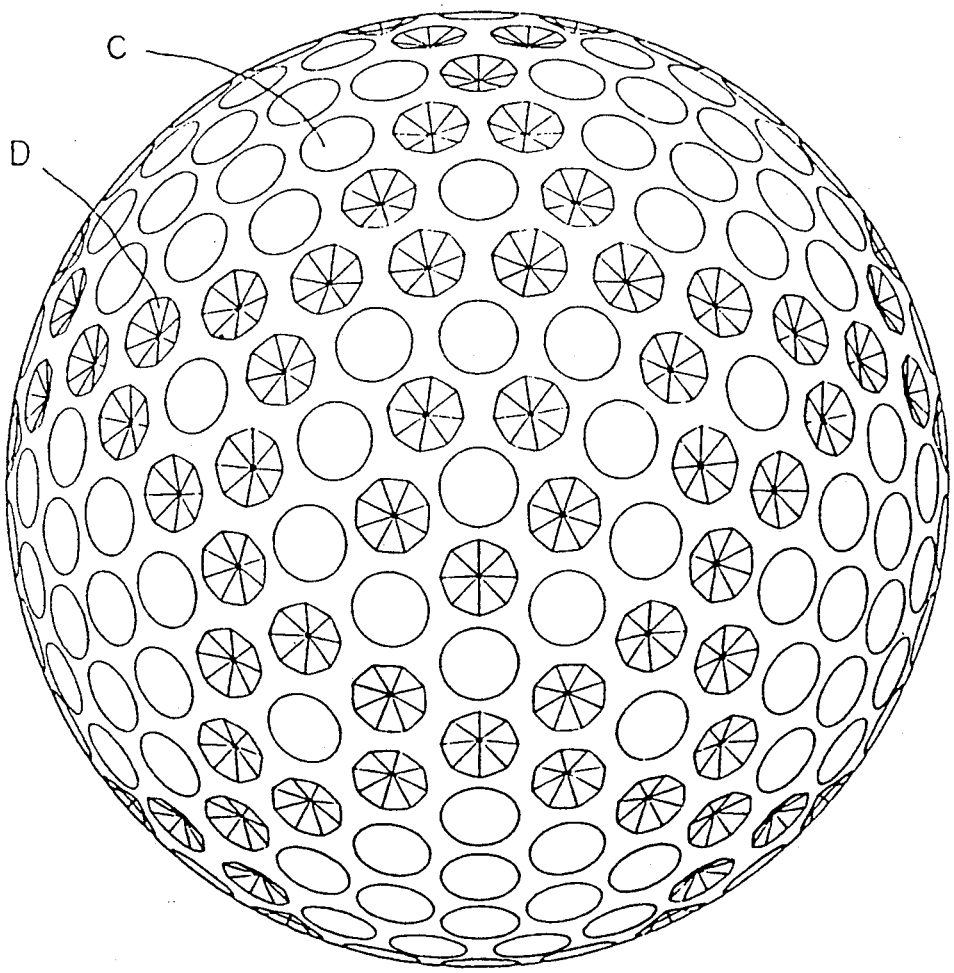
FIG. 6 is a plan view of a golf ball according to the second embodiment of the present invention.

FIGS. 5 and 6 show a golf ball according to a second embodiment of the present invention. The golf ball has on the surface thereof circular dimples (C) and regular octagonal dimples (D). The length, namely, the diameter of the circular dimple (C) is 3.50 mm and the total number of the dimples (C) is 202. The length of the octagonal dimple (D) is 3.50 mm and the total number of the dimples (D) is 130.

According to the golf ball of the second embodiment, each regular octagonal dimple (D) is adjacent to at least one circular dimple (C). That is, there is no dimple (D) which is not adjacent to the dimples (C). 132 of 202 circular dimples (C) are adjacent to the regular octagonal dimples (D) and 70 dimples (C) are unadjacent to the dimples (D). That is, according to the golf ball of the second embodiment, 70 dimples, namely, approximately 21% of the total number (332) of dimples are unadjacent to dimples different in surface configuration.

In order to examine the flight performance of the golf ball in accordance with the present invention, comparison test were conducted by preparing first comparison golf balls corresponding to the golf balls of the first embodiment and second comparison golf balls corresponding to the golf balls of the second embodiment.

The dimple specifications of the golf balls of the first embodiment, the second embodiment, the first comparison golf balls, and the second comparison golf balls are shown in Table 1.

TABLE 1

| | dimple Specification | | | |
|---|---|---|---|---|
| kind of dimple | configuration | number of dimples | diameter of dimple | total number of dimples |
| first embodiment | | | | |
| A | regular quadrangle | 216 | 4.10 | 336 |
| B | regular hexagon | 120 | 3.70 | |
| second embodiment | | | | |
| C | circular | 202 | 3.50 | 332 |
| D | regular octagon | 130 | 3.50 | |
| first comparison | | | | |
| E | circular | 168 | 4.20 | 336 |
| F | circular | 168 | 3.10 | |
| second comparison | | | | |
| G | regular hexagon | 332 | 3.50 | 332 |

Figure 7:
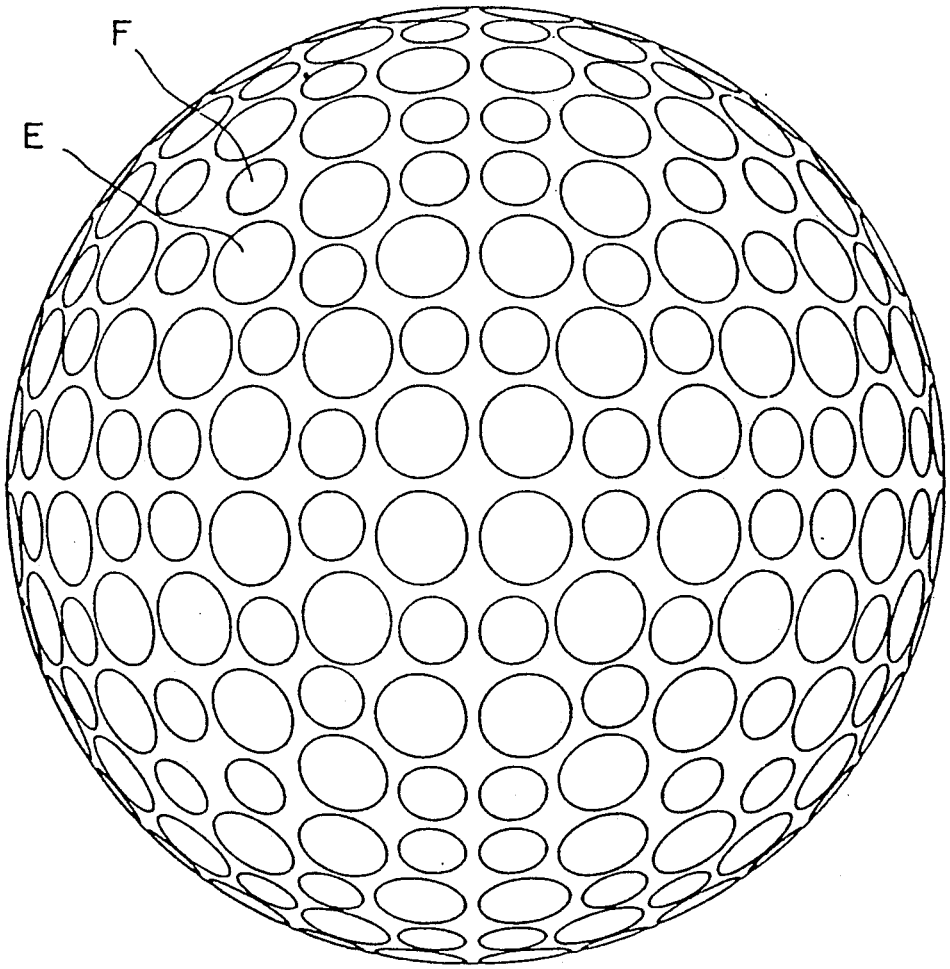
FIG. 7 is a front view of a first comparison golf ball.
Figure 8:
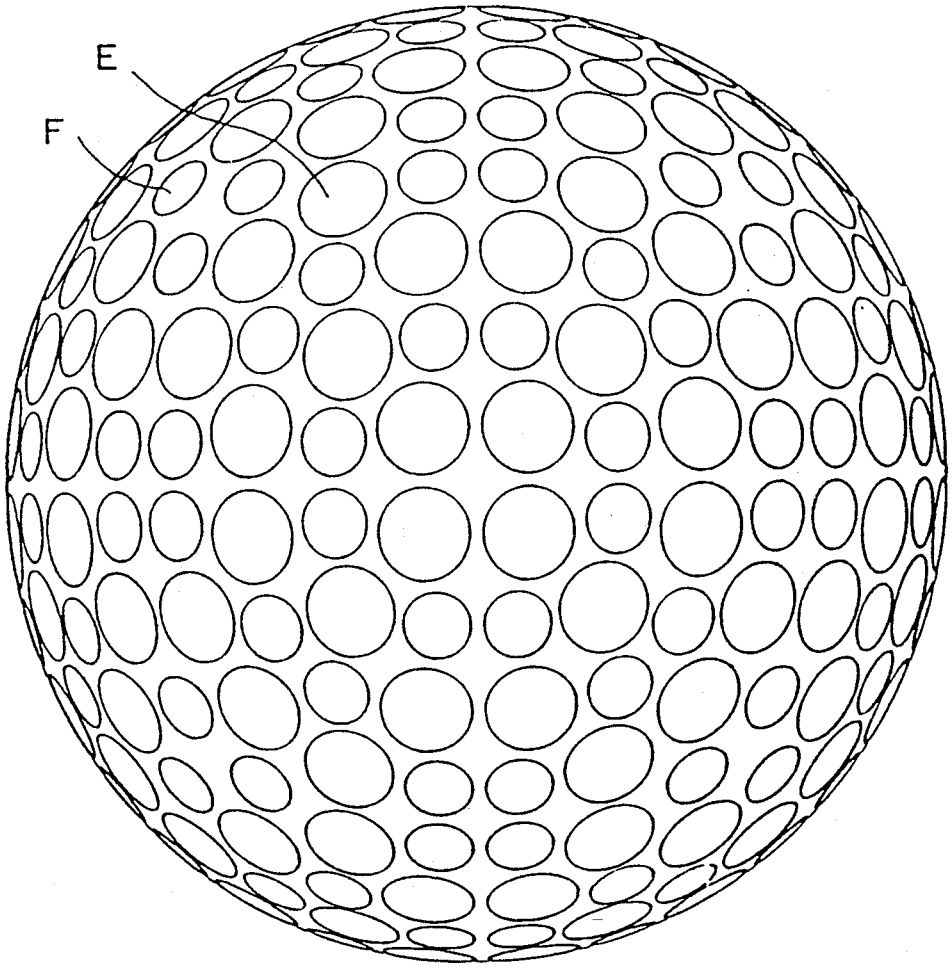
FIG. 8 is a plan view of the first comparison golf ball.

As shown in FIGS. 7 and 8 and Table 1, the dimples of the first comparison golf ball consist of dimple (E) and dimple (F) identical to each other in surface configuration, but different from each other in surface area. Each dimple (E) is adjacent to at least one dimple (F). Similarly, each dimple (F) is adjacent to at least one dimple (E).

The total number of the first comparison golf balls is the same as that of the golf ball of the first embodiment. The position of each dimple of the first comparison golf ball corresponds to that of the golf ball of the first embodiment.

Figure 9:
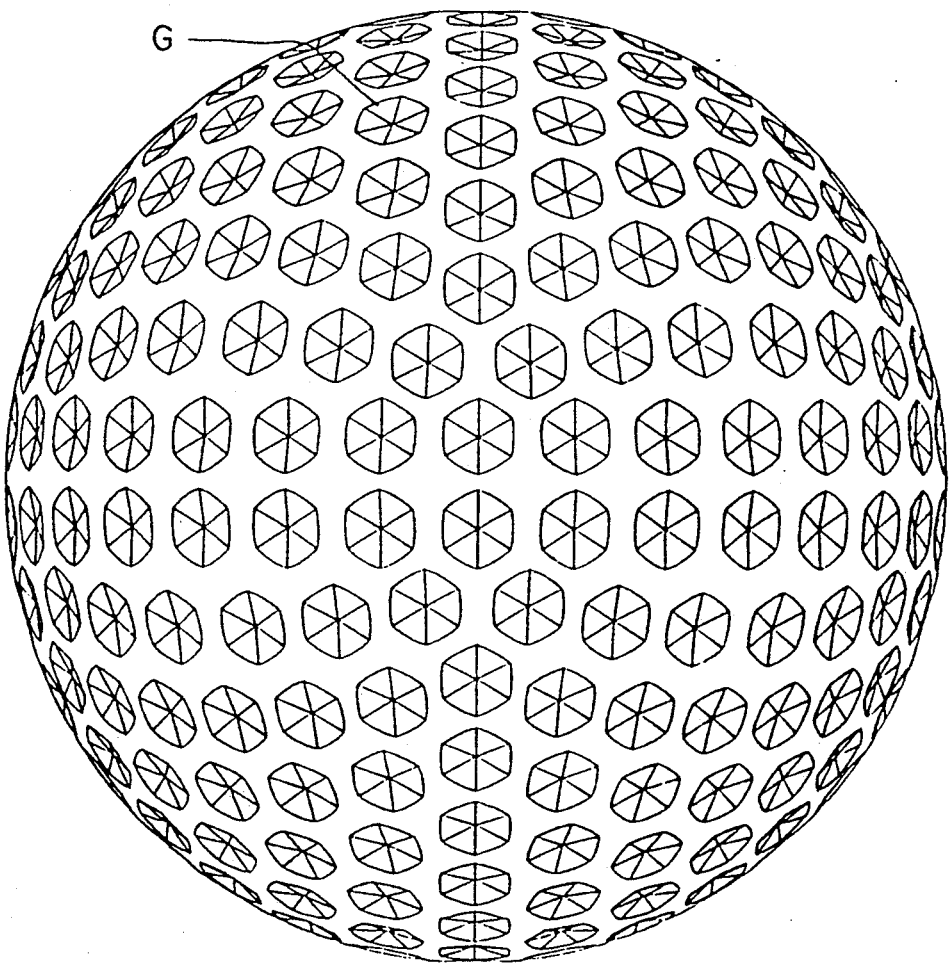
FIG. 9 is a front view of a second comparison golf ball.
Figure 10:
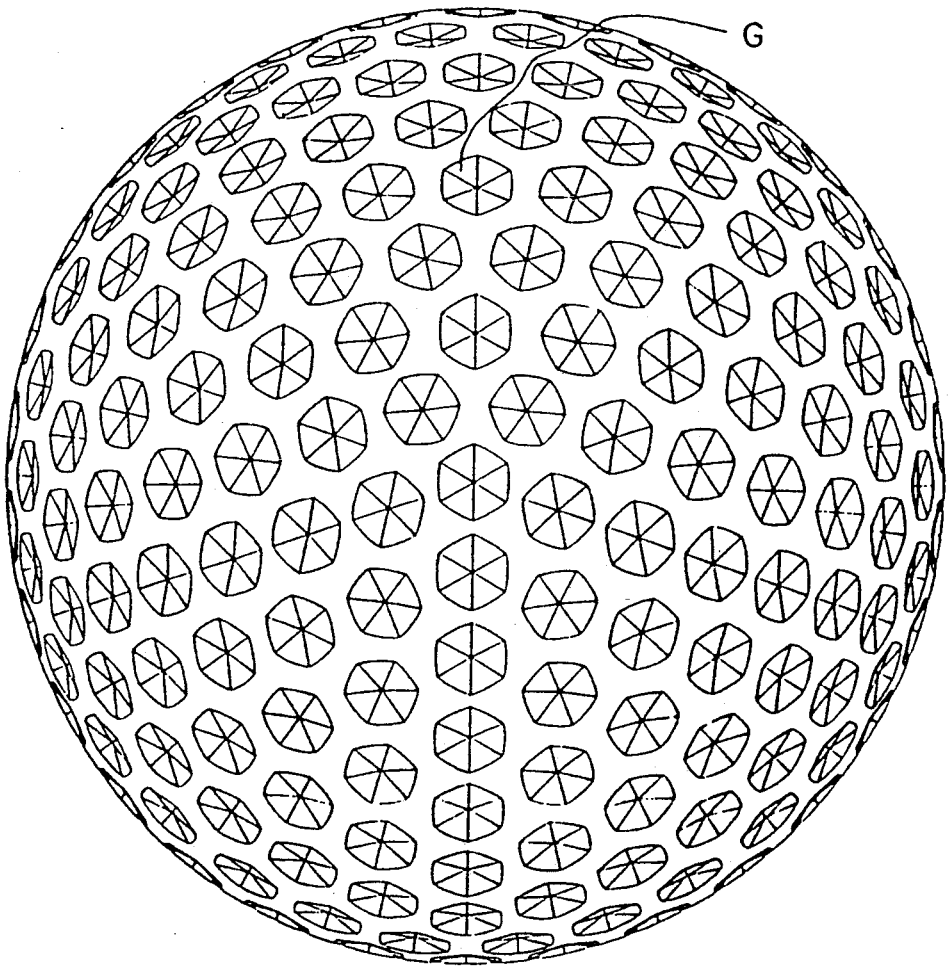
FIG. 10 is a plan view of the second comparison golf ball.

As shown in FIGS. 9 and 10 and Table 1, the dimples of the second comparison golf ball are all regular hexagonal in surface configuration. The total number of the second comparison golf balls is the same as that of the golf balls of the second embodiment. The position of each dimple of the second comparison golf ball corresponds to that of the golf ball of the second embodiment.

The golf ball of the first and second embodiments and the first and second comparison golf balls comprises thread wound around a liquid center and a balata cover, and has the same construction composed of materials of the same mixing proportion. The outer diameter is each 42.70±0.03 mm and the compression is each 95±2.

The experimental results of the golf balls of the first and second embodiments and the first and second comparison golf balls are described below. Flight tests were conducted on the golf balls using a swing robot manufactured by True Temper Corp. The golf balls were hit by a driver (No. 1 wood) at a head speed of 45 m/s, at a spin of 3500±300 rpm, and a launching angle of 10±0.5\. The number of golf balls was 20 for each kind. The average value of measurements is shown for each kind of golf ball in Table 2 below.

TABLE 2

| | Flight Test | | | |
|---|---|---|---|---|
| | carry (yard) | total (yard) | trajectory height | duration of flight (sec) |
| first E | 228.6 | 244.0 | 13.5 | 6.0 |
| second E | 226.0 | 243.2 | 13.3 | 5.9 |
| first C | 222.3 | 239.6 | 12.9 | 5.7 |
| second C | 219.5 | 237.0 | 12.6 | 5.6 |

E: embodiment. C: comparison

Trajectory height means the angle of elevation viewed from a launching point of golf ball to the highest point in trajectory.

As apparent from Table 2, the carry, trajectory height and total of the golf balls of the first and second embodiments are longer than those of the first and second comparison golf balls.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A golf ball comprising 280 to 540 dimples with at least two types of dimples of different surface configurations being formed thereon, in which the percentage of dimples unadjacent to dimples of different surface configurations is less than 30 of a total number of dimples, the types of dimples of different surface configurations consist of a combination of circular dimples and regular polygonal dimples or regular polygonal dimples of a different number of sides, with the circular dimples generally having the shape of a circle.

2. The golf ball as claimed in claim 1, wherein the golf ball only has dimples in the shape of a circle and dimples of regular polygonal shape.

3. The golf ball as claimed in claim 2, wherein the regular polygonal dimples have eight sides.

4. The golf ball as claimed in claim 3, wherein the circular dimples have a diameter of 3.50 mm and wherein over two hundred circular dimples are present on the golf ball.

5. The golf ball as claimed in claim 4, wherein a length of a diagonal line of the regular polygonal dimples is 3.50 mm and a total number of regular polygonal dimples is 130.

6. The golf ball as claimed in claim 3, wherein a length of a diagonal line of the regular polygonal dimples is 3.50 mm and a total number of regular polygonal dimples is 130.

7. The golf ball as claimed in claim 1, wherein the golf ball only has regular polygonal dimples of different number of sides.

8. The golf ball as claimed in claim 7, wherein two sets of polygonal dimples are provided, the first set has four sides and the second set has six sides.

9. The golf ball as claimed in claim 8, wherein the dimples having four sides are regular quadrangular dimples with a length of a diagonal line being 4.10 mm and a total number of 216 dimples being provided.

10. The golf ball as claimed in claim 9, wherein the dimples having six sides are regular hexagonal dimples with a length of a diagonal line being 3.70 mm and a total number of 120 dimples being provided.

11. The golf ball as claimed in claim 8, wherein the dimples having six sides are regular hexagonal dimples with a length of a diagonal line being 3.70 mm and a total number of 120 dimples being provided.

* * * * *